United States Patent [19]

Masuda et al.

[11] 4,373,516

[45] Feb. 15, 1983

[54] APPARATUS FOR CHIROPRACTIC THERAPY AND MASSAGE

[75] Inventors: Teruo Masuda, Itaukaichi; Masayasu Morita, Fuchu; Kazuyuki Yamaguchi, Sayama; Yoshikazu Harada, Akishima, all of Japan

[73] Assignee: France Bed Co., Ltd., Tokyo, Japan

[21] Appl. No.: 213,647

[22] Filed: Dec. 5, 1980

[30] Foreign Application Priority Data

| | | | |
|---|---|---|---|
| Dec. 27, 1979 | [JP] | Japan | 54-180193[U] |
| Dec. 27, 1979 | [JP] | Japan | 54-180194[U] |
| Apr. 8, 1980 | [JP] | Japan | 55-47562[U] |
| May 15, 1980 | [JP] | Japan | 55-64278 |
| May 15, 1980 | [JP] | Japan | 55-66578[U] |
| May 15, 1980 | [JP] | Japan | 55-66579[U] |

[51] Int. Cl.[3] ..... A61H 1/00

[52] U.S. Cl. ..... 128/57; 74/501.5 R; 128/64

[58] Field of Search ..... 128/57, 56, 52, 32, 128/33; 74/470, 501.5 R; 254/226; 474/2, 75, 101; 24/32; 114/144 R; 440/63, 62; 267/74

[56] References Cited

U.S. PATENT DOCUMENTS

| | | | |
|---|---|---|---|
| 1,690,957 | 11/1928 | Tommins | 267/74 |
| 2,909,137 | 10/1959 | Anderson | 128/33 |
| 3,039,458 | 6/1962 | Hill | 128/33 |
| 3,359,823 | 12/1965 | Brazier | 74/501.5 |
| 3,628,528 | 12/1971 | Roberts | 128/57 |
| 3,640,272 | 2/1972 | Hussey | 128/33 |
| 3,664,333 | 5/1972 | Hill | 128/52 |
| 3,882,856 | 5/1975 | Heuser et al. | 128/57 |
| 4,154,232 | 5/1979 | Fukazawa | 128/57 X |
| 4,190,043 | 2/1980 | Thompson | 128/33 |

FOREIGN PATENT DOCUMENTS 255077 11/1926 United Kingdom .

*Primary Examiner*—Dalton L. Truluck
*Assistant Examiner*—David J. Brown
*Attorney, Agent, or Firm*—Frishauf, Holtz, Goodman & Woodward

[57] ABSTRACT

Apparatus for chiropractic therapy and massage having a housing on which the user lies, pressure means including a number of pressure rollers disposed in the housing which rolls to apply pressure on the user lying on the housing, a support frame provided in the housing and supporting the pressure roller, a pair of pulleys provided in the housing, and a wire stretched between the pulleys to reciprocate the support frame. The apparatus further comprises a spring coupled to both ends of the wire for absorbing the elongation and contraction of the wire; and first and second interlocking members coupled to both ends of the wire and to the support frame for transmitting the driving force of the wire directly to the support frame without transmitting the driving force to the spring.

14 Claims, 15 Drawing Figures

APPARATUS FOR CHIROPRACTIC THERAPY AND MASSAGE

BACKGROUND OF THE INVENTION

This invention relates to an apparatus for chiropractic therapy and massage, and more particularly an apparatus which performs a chiropractic therapy and massage, using pressure rollers which make a reciprocating movement.

The apparatus of this sort generally has a construction which comprises a housing with a sheet stretched over an open side thereof and a support frame supporting pressure means carrying a plurality of pressure rollers and mounted for reciprocating movement in the housing. The support frame is driven by a power source such as a reversible motor for recprocating movement within the housing, whereby a user lying on the sheet is massaged by the pressure rollers of the pressure means.

Strictly speaking, chiropractic therapy and massage are different in a sense. The former refers to pressure treatment on the body by pressure rollers temporarily held in a fixed position, while the latter refers to the operation of massage of the body by pressure rollers moved with the movement of the support frame. However, both chiropractic therapy and massage are usually thought to be the same thing, so their strict distinction is not always made in the following description.

With the chiropractic therapy and massage apparatus of the above construction, the user's weight is applied to the support frame. This, therefore, tends to obstruct the smooth reciprocating movement of the support frame and thus reduce the chiropractic or massage effect. It is thus necessary to provide a mechanism for ensuring the reliable transmission of the driving force from the power source to the support frame.

In the well-known chiropractic therapy and massage apparatus, the driving force from the power source is transmitted to the support frame by a chain or a wire. Where a chain is used, the driving force from the power source can be securely transmitted to the supported frame because the chain does not slip. On the demerit side, however, the chain is very expensive compared with the wire, and also the use of the chain leads to the generation of noise. In the case of using a wire, although it is inexpensive compared with the chain and does not produce noise, the wire is liable to generate slip because it is subject to elongation with a change of its tension caused when driving the support frame with a heavy load. The generation of slip is undesired from the standpoint of smooth driving of the support frame.

In another aspect, in the well-known chiropractic therapy and massage apparatus the stroke of reciprocation of the support frame along the housing is usually fixed and cannot be freely varied by the user. More particularly, with the prior-art chiropractic therapy and massage apparatus the stroke of the support frame, i.e., the stroke of the pressure mans including a plurality of pressure rollers, is set such that the pressure rollers are moved substantially over the whole body of the user lying on sheet. Therefore, while the apparatus is useful when it is desired to obtain chiropractic therapy or massage over the whole body, inconvenience is felt when it is desired to obtain concentrated chiropractic therapy or massage on a portion of the body.

In a further aspect, satisfactory chiropractic therapy or massage effect cannot be obtained with the prior apparatus unless strong urging forces are exerted by the pressure rollers of the pressure means running within the housing to the body of the user lying on the sheet. Accordingly, cloth having an expansible characteristic is used as the sheet stretched on the open said of the housing so that it is deformed by the user lying on it to let the user's body be sufficiently sunk in the housing and thereby increase the urging force applied by the pressure rollers to the user.

However, if the urging force exerted by the pressure rollers is increased in this way, it is likely that the large load is applied to the sheet when the user lies thereon or the body of the user is vertically rocked with the sheet as the pressure rollers are moved along the underside of the user. Therefore, the user's body is liable to strike through the sheet the hard inner wall of the housing or wire or chain stretched within the housing and driven by the power source for driving the pressure rollers. If this occurs, the user feels displeasure. Also, the sheet is rubbed by the wire or the chain so that it is damaged soon.

In a still further aspect, it has recently been contemplated to enhance the chiropractic therapy or massage effect of pressure rollers by permitting strong pressure to be applied to what is called particular physiological spots of the body with a number of protuberances provided on the outer periphery of the pressure rollers. The particular physiological spots of the body are located along the opposite sides of the backbone, so that it is in general practice to provide a pair of pressure rollers on a shaft such that these rollers are moved along the opposite sides of the backbone.

However, the backbone becomes progressively thicker, although slightly, from the spinal column toward the lumber vertebra, and the distance between the opposite side particular physiological spots is progressively increased with the increase of the thickness of the backbone. Therefore, where a pair of pressure rollers provided with peripheral protuberances are driven with shaft carrying them at a fixed spacing through the housing, the pressure effect of the protuberances are not given to all of the particular physiological spots, that is, satisfactory chiropractic therapy and massage cannot be obtained.

Even in this case, the protuberances provided on the periphery of the pair of pressure rollers press the particular physiological spots and can give local pressure effect. However, it is only small local portions of the body that are given strong forces by the protuberances of the pressure rollers, and what is called massage effect, i.e., the effect of rubbing the whole muscle of the body, is hardly obtained. Therefore, for concurrently obtaining both the chiropractic therapy effect and massage effect it is necessary to provide pressure means having pressure rollers without any protuberance and serving to provide the massage effect as well as pressure means having pressure rollers provided with protuberances.

In a yet further aspect, the smaller the stroke of the support frame the greater the number of cycles of pressure application by the pressure rollers per unit time so that the greater is the massage effect. In the usual chiropractic therapy and massage apparatus the pressure means has only a single pair of pressure rollers for massaging the whole body from the neck through the hip to the legs, to improve the chiropractic effect or massage effect. There has been proposed an apparatus which has two pressure roller pairs mounted in a support frame in such a manner that these pairs are spaced apart from each other in the longitudinal direction of the housing. With this type of chiropractic therapy and massage apparatus, the pressure roller pair on the side of the head of the user serves to apply pressure to a portion of the body from the neck to the hip while the other pressure roller pair applies pressure to the other portion of the body, namely from the hip to the end of the legs. In this chiropractic therapy and massage apparatus, the pressure rollers of each pair are mounted on a shaft with the same space provided for the protuberance of one roller of the pair with respect to that of the other roller. However, the particular physiological spots on the opposite side of the backbone and those of the legs are spaced apart by different distances. In the naturally lying state of the body, the distance between the particular pysiological spots of the legs is greater than the distance between the those on the opposite sides of the backbone. Therefore, with the fixed space of the protuberances of the pressure rollers in the axial direction of the shaft thereof, the user lying in the natural state cannot obtain pressure effects concurrently on the particular pysiological spots on the opposite sides of the backbone and on those of the legs. If it is intended to obtain both the chiropractic therapy effect and massage effect of the pressure roller pairs, the user has to change his posture from the natural one, for instance by changing the distance between the legs to meet the lateral spacing of the protuberances of the pressure roller pair positioned on the side of the legs.

It is a primary object of this invention to provide an apparatus for chiropractic therapy and massage, in which the support frame is smoothly reciprocated by using a wire.

SUMMARY OF THE INVENTION

To achieve this object, the apparatus for chiropractice therapy and massage according to this invention comprises means coupled to both ends of a wire for absorbing the elongation and contraction of the wire, and means for coupling the both ends of the wire to a support frame for transmitting the driving force of the wire directly to the support frame without transmitting the driving force to absorbing means.

The above and further objects and novel features of the invention will more fully appear from the following detailed description when the same is read in connection with the accompanying drawing. It is to be understood, however, that the drawing is for the purpose of illustration only and is not intended as a definition of the limits of the invention.

DETAILED DESCRIPTION

Figure 1:
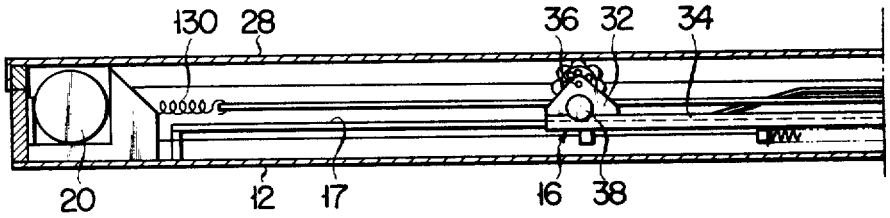
FIG. 1 is a longitudinal sectional view showing a first embodiment of the apparatus for chiropractic therapy and massage according to the invention.
Figures 1, 2:
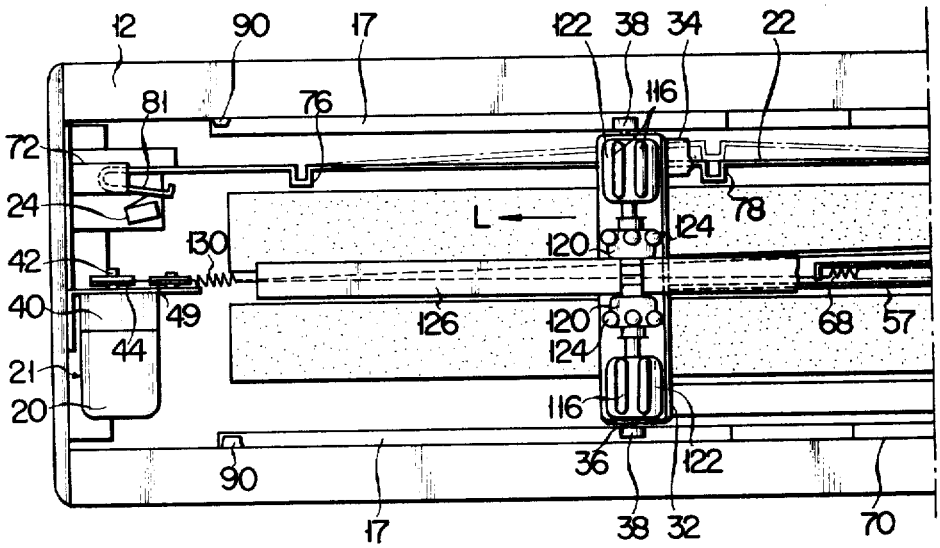
FIG. 2 is a plan view of the first embodiment with sheet thereof removed.
Figures 1, 2:
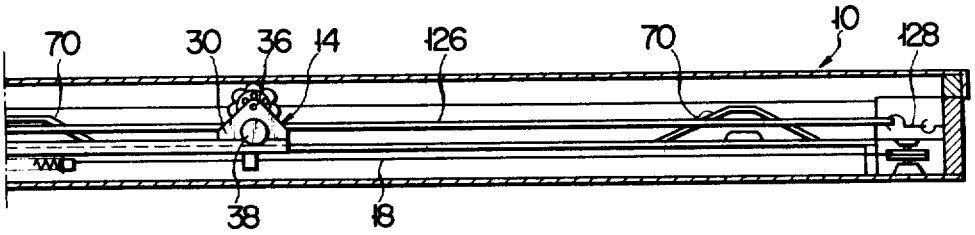
Figure 2:
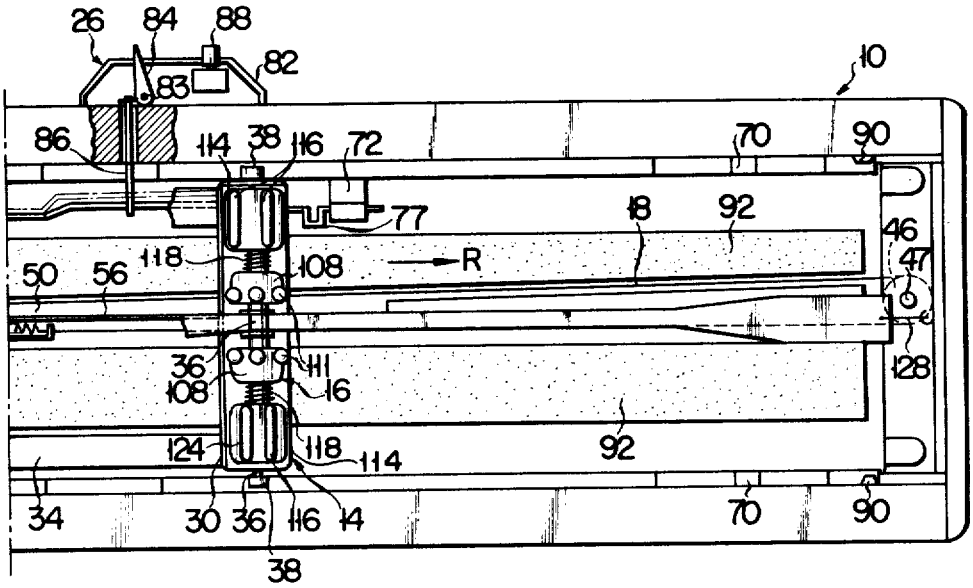

The construction of the preferred embodiment will be outlined. As shown in FIGS. 1 and 2, the chiropractic therapy and massage apparatus 10 according to the invention comprises a housing 12, which is adapted to support a user lying on it. A support frame 14 is mounted for reciprocating movement within the housing 14. In the support frame 14, pressure means 16 carrying pressure rollers are mounted. The support frame 14 supporting the pressure means 16 is disposed on rails 17 provided within the housing 12 and is coupled to a wire 18. The wire 18 is driven by a power source 21 having a reversible motor 20. When the wire 18 is driven the support frame 14 is moved along the rails 17, whereby the user on the housing is given chiropractic therapy and massage by the pressure rollers of the pressure means 16. When the support frame 14 is moved to cover a predetermined stroke, it causes sliding action of a control bar 22, which constitutes stroke control means 23 and is provided within the housing, to cause switching of a switch 24. With this switching of the switch 24 the reversible motor 20 is exchanged to reverse the direction movement of the support frame 14. When the support frame 14 has been moved in the opposite direction to cover the predetermined stroke, the motor 20 is reversed again to cause reversal of the direction of movement of the support frame. In this way, the support frame 14 is reciprocated with the switch 24 switched every time the stroke is covered. The stroke of the support frame 14 can be changed when the control bar 22 is elastically deformed by stroke selection means 26.

Now, the component parts of the chiropractic therapy and massage apparatus 10 will be described in detail. As shown in FIGS. 1 and 2, the housing 12 is in the form of a box-like shape and is open at its top, and a sheet 28 of cloth or the like capable of expansion and contraction is stretched to cover the open side of the housing. A pair of parallel rails 17 extend within the housing 12 in the longitudinal direction thereof. The support frame 14 is constituted by first support 30 and second support 32 spaced apart in the longitudinal direction, the first support 30 being positioned on the side of the head of the user and the second support 32 positioned on the side of the legs of the user. A pair of connection plates 34 connect the opposite ends of these supports 30 and 32. The supports 30 and 32 each have a shaft 36, which carries wheels 38 mounted on it at the opposite ends. These wheels 38 run along the rails 17, whereby the support frame 17 is moved along the rails 17.

As seen from FIGS. 1 and 2, the power source 21 is mounted within the housing 12 at the left hand end thereof, and it includes a reversible motor 20 and a speed change gear 40. A shaft 42 horizontally extends from the speed change gear 40 and carries a drive pulley 44 secured to it. A driven pulley 46 is provided within the housing 12 at the right hand end thereof, and its shaft 47 vertically extends. The wire 18 is stretched between these pulleys 44 and 46. An auxiliary pulley 49 is provided in the neighborhood of the drive pulley 44 for ensuring sufficient contact of the wire 18 with the drive pulley 44.

Figure 3:
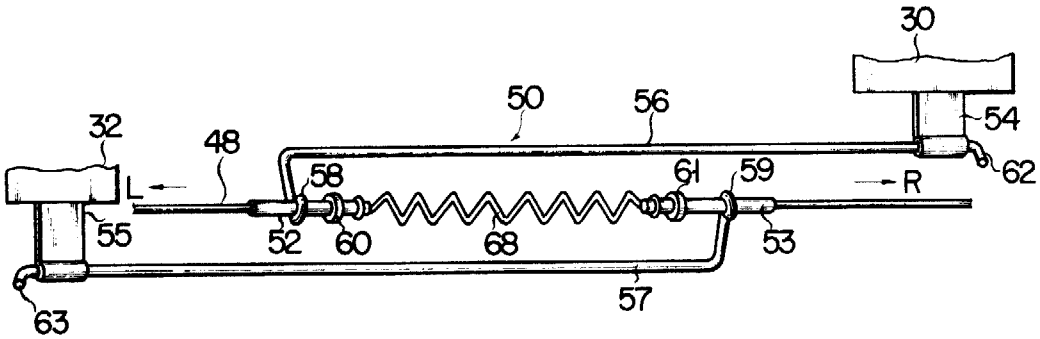
FIG. 3 is an enlarged side view showing wire coupling means in the first embodiment.

As shown in FIG. 3, the opposite ends of the wire 18 are coupled by wire coupling means 50 to the first support 30 and second support 32 of the support frame 14. The wire coupling means 50 includes a pair of coupling members 52 and 53, such as pins, respectively coupled to the opposite ends of the wire 18 and a pair of support members 54 and 55 depending from the respective supports 30 and 32. It also includes a pair of interlock bars 56 and 57 made from, for instance, a hard steel wire. The interlock bar 56 is slidable with respect to the coupling member 52 and the support member 54, and the interlock bar 57 is slidable with respect to the coupling member 53 and the support member 55. These interlock bars 56 and 57 respectively have loop portions 58 and 59 formed at their one end. The loop portions 58 and 59 are slidable along the respective coupling members 52 and 53. The interlock bars 56 and 57 also have respective stoppers 60 and 61, such as flanges, which restrict the movement of the loop portions 58 and 59 with respect to the coupling members 52 and 53. The other end portion of each of the interlock bars 56 and 57 is slidably supported in a loop portion of each of the support members 54 and 55, and these other end portions include respective bent retainer portions 62 and 63 for preventing detachment of the interlock bars from the support members so as to act as stoppers. Elongation/contraction absorbing means 68 for absorbing the elongation and contraction of the wire 18 is connected between the coupling members 52 and 53. In this embodiment, the elongation/contraction means 68 is in the form of a tension spring, but it is to be understood that any other member having the function of absorbing the elongation and contraction of wire can be used in lieu of the tension spring.

When the reversible motor 20 of the power source 21 is rotated in a direction of moving the support frame 14 to the left in FIGS. 1 and 2, the wire 18 is driven in the direction of arrow L shown in FIG. 3. At the time, the wire 18 is momentarily driven until a state, in which the stopper 60 is in contact with the loop portion 58 of the interlock bar 56 and the bent retainer 62 thereof is in contact with support member 54. Then, the wire 18 pulls the support 30 with the interlock bar 56, thus moving the support frame 14 to the left. At this time, the support 32 is moved with the support 30, so that no pulling force is transmitted from the support 32 to the coupling member 53 through the interlock bar 57. When the wire 18 is driven in the direction of arrow R, similar function takes place, and the wire 18 pulls this time the support 32 through the interlock bar 57, thus moving the support frame 14 to the right. At this time, no pulling force is transmitted to the coupling member 52. In the above way, the support frame 14 is reciprocated. The interlock bar 56 or 57 is drivingly coupled to the support 30 or 32 through the coupling member 52 or 53 according to the direction of driving of the wire 18, so that the wire pulls the support 30 or 32. At this time, the other interlock bar is free, i.e., is not drivingly coupled to the other support, so that the tension in the wire 18 is directly transmitted to either support through the associated coupling member and interlock bar and is not transmitted to the tension spring 68. Thus, the support frame 14 can be smoothly moved by the wire 18, and the tension spring 68 will not be damaged by the tension in the wire 18. Further, if the wire 18 undergoes elongation or contraction, this elongation or contraction is absorbed by the urging force of the tension spring 68 connected between the opposite ends of the wire 18. Thus, fluctuation of the wire tension can be prevented and drive pully 44 is kept constant. In this way, the wire 18 is driven under a constant tension and smooth driving of the support frame 14 can be ensured.

Figure 4:
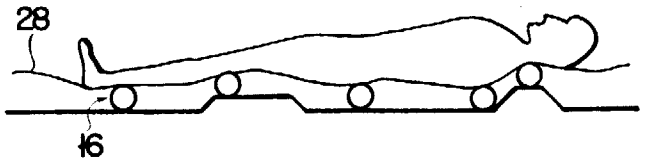
FIG. 4 is a schematic view showing the manner in which pressure means is moved along rails.

The rails 17 have a plurality of cam portions 70 (see FIGS. 1 and 2) to cause vertical displacement of the support frame 14 running therealong and vertical displacement of the pressure means 16 supported on the support frame 14. These cam portions 70 are formed at positions corresponding to the neck and legs of the user, when the user is lying on the sheet 28 provided at the open top of the housing 12 as shown in FIG. 4. In other words, the rails 17 have a profile practically conforming to the profile of the back of the user so that the pressure rollers of the pressure means 16 may apply uniform pressure to the user's back over their entire stroke.

Figure 5:
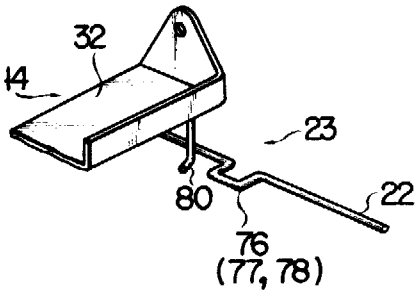
FIG. 5 is a perspective view showing the relation between a support frame and stroke control means.

As shown in FIG. 2, a pair of support members 72 are provided on the inner wall of the housing 12, and an elastically deformable control bar 22 for controlling the stroke of the support frame 14 extends in the direction of movement of the support frame 14 and is supported by the support members 72 such that it is slidable relative thereto but is incapable of detachment therefrom. The control bar 22 is made from a hard steel, and it has horizontally projecting bent portions 76 and 77 provided near its opposite ends and also a further horizontally projecting bent portion 78 provided in its intermediate portion. As shown in FIG. 5, an actuating pin 80 downwardly projects from the second support 32 of the support frame 14, and it is capable of engaging the bent portions 76, 77 and 78 of the control bar 22. When the support frame 14 is being moved by the wire 18, the actuating pin 80 comes to engagement with either one of the bent portions 76, 77 and 78, whereby the control bar 22 is moved with the support frame.

The control bar 22 has a hair-pin-like left hand end 81, and a switch 24, for instance a microswitch, is provided within the housing 12 such that it co-operates with the hair-pin-like end 81. When the control bar 22 is moved with the support frame 14, an action of switching of the switch 44 by its hair-pin-like end 81 takes place, and with this action the direction of rotation of the reversible motor of the power source is reversed.

As shown in FIG. 2, a stroke selection means 26 for changing the stroke of the support frame 14 is provided on one side wall of the housing 12. The stroke selection means 26 comprises an operation box 82 provided on the outer wall surface of the housing 12, and a select lever 84 pivotable about a pin 83 is accommodated within the operation box such that its end portion projects therefrom. The stroke selection means 26 further includes a connecting rod 86 penetrating the wall of the housing 12. The connecting rod 86 is coupled at one end by a pin (not shown) to the other end of the select lever 84, and is coupled at the other end to the control bar 22, which extends through a hole (not shown) formed in the other end of the connecting rod. When the select lever 84 is rotated in the clockwise direction about the pin 83, the rod 86 is outwardly displaced, thus causing deformation of the elastically deformable control lever 22 toward the side wall of the housing as shown by broken lines in FIG. 2. At this time, the displacement of the central portion of the control bar 22 is greater than the displacement of the end portions, and thus the central bent portion 78 is displaced sidewise to a greater extent than the other bent portions 76 and 77 in the end portions. In effect, the control bar 22 is deformed by the connecting rod 86 until the actuating pin 80 of the support 32 (FIG. 5) is no longer capable of engaging the central bent portion 78. The operation box 82 is also provided with a timer 88 for setting the operation period of the power source 21.

The rails 17 are provided at their opposite ends with stoppers 90, being four in number, for preventing the detachment of the support frame 14 from them.

On the opposite sides of the wire 18, which is stretched along the bottom of the housing 12, a pair of elastic protective members 92 of a semi-hard foam material are attached to the bottom wall. These protective members have a thickness greater than the height of the wire 18 from the bottom. When the user lies on the sheet 28, great load is applied to the sheet. In such a case and also with the vertical rocking of the user M lying on the sheet caused with the reciprocating movement of the support frame 14, the sheet is greatly deformed so that the user tends to sink into the housing 12. In this case, however, the downward load is received by the elastic protective members 92 through the deformed sheet 28, and the user does not feel any displeasure at all by virtue of the soft touch of the elastic protective members. In addition, since the elastic protective members 92 have a thickness greater than the height of the wire 18 from the housing bottom, there is no possibility for the sagging sheet 28 to be rubbed and damaged by the wire. As an inexpensive and highly elastic material of the elastic protective members 92, polyethylene foam may be used.

Figure 6:
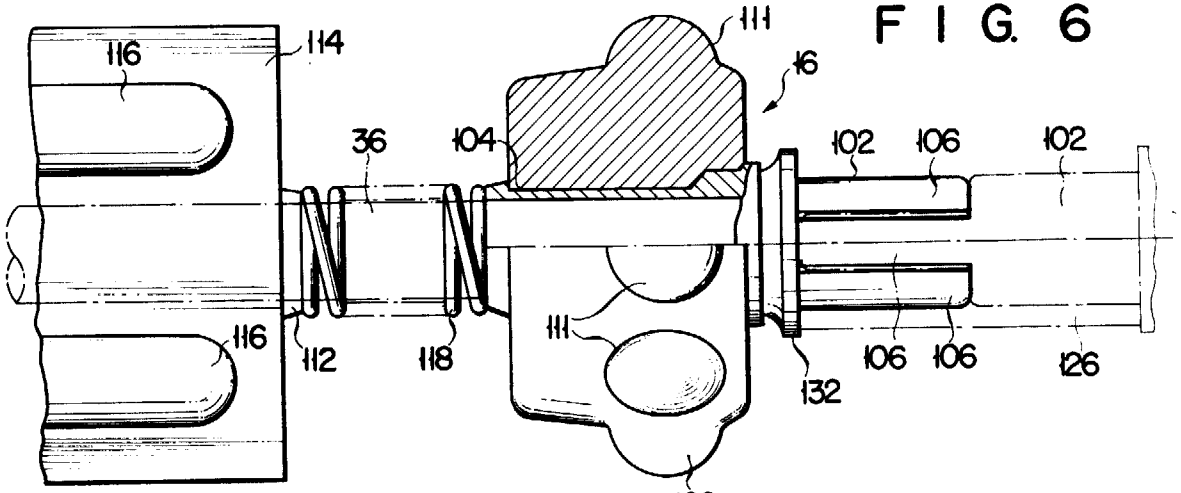
FIG. 6 is a fragmentary front view showing the pressure means.
Figure 7:
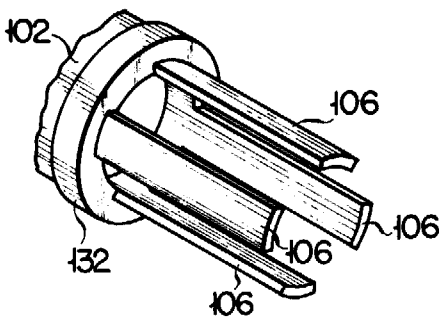
FIG. 7 is a fragmentary perspective view showing a sleeve.

The shaft 36 mounted in the first support 30 of the support frame 14 carries a pair of first sleeves 102 fitted on its central portion. As shown in FIG. 6, each of these first sleeves 102 has a peripheral annular recess 104, in which a pressure roller of the pressure means 16 is mounted, and also has a plurality of, for instance four, engagement extensions 106 axially extending from its one end. As shown in FIG. 7, the engagement extensions 106 of each sleeve are radially uniformly spaced apart such that the gaps between adjacent extensions are enough to receive the engagement extensions of the other sleeve. As shown in FIG. 6, the pair sleeves 102 are loosely fitted on the central portion of the shaft 36 such that the engagement extensions 106 of each sleeve lie in the gaps between adjacent engagement extensions of the other sleeve. Thus, the sleeves 102 can be rotated with each other on the shaft 36 due to the engagement of their engagement extensions 106, and also they can be independently moved toward or away from each other in the axial direction of the shaft. The chiropractic roller 108, which is the first pressure roller of the pressure means 16 and is mounted in the peripheral annular recess 104 of each sleeve 102, is made of an elastic material such as hard rubber and has a number of partial spherical protuberances 111 projecting from its outer periphery near its inner end. The shaft 36 also carries a pair of second sleeves 112 loosely fitted on its opposite end portions. Each of these second sleeves 112 has an annular recess (not shown), in which a massage roller as the second pressure roller of the pressure means 16 is mounted. Each second sleeve has a well-known sleeve form without any engagement extension. The massage roller 114 has a greater width dimension than the chiropractic therapy roller 108, and it is also made of an elastic material such as hard rubber and has a number of partial cylindrical axial ridges 116 formed on its outer periphery. A compression spring 118 is interposed between each first sleeve 106 and the corresponding second sleeve 112. The compression spring 118 urges the associated first sleeve 102 and second sleeve 112 away from each other, so that the pair of first sleeves 102 provided on the central portion of the shaft 36 are urged toward each other (see FIG. 8).

Figure 8:
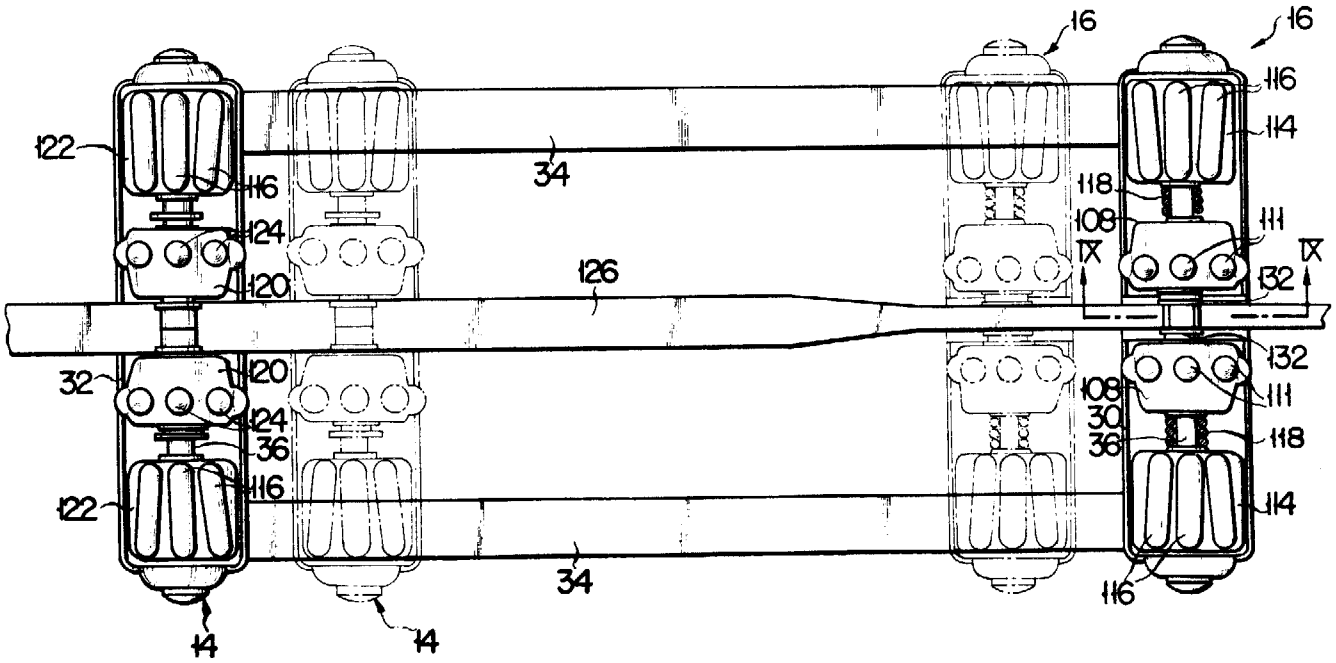
FIG. 8 is a plan view showing the pressure means.

The shaft 36 mounted in the second support 32 of the support frame 14, like the shaft 36 mounted in the first support 30, carries first and second pair sleeves 102 and 112 rotatably fitted on it. As shown in FIG. 8, second chiropractic rollers 120 which are third pressure rollers of the pressure means 16 are mounted in the respective first sleeves 102, and second massage rollers 122 of the pressure means 16 are mounted in the respective second sleeves 112. The second chiropractic rollers 120 are each made of an elastic material and has a number of partial spherical protuberances 124. In the illustrated embodiment, the first chiropractic rollers 108 and second chiropractic rollers 120 are identical rollers except that they are installed on the respective shafts 36 in opposite orientation. More particularly, the first pair of chiropractic rollers 108 are installed on their shaft 36 such that their ends, adjacent to which the protuberances are provided, face each other, whereas the second pair of chiropractic rollers 120 are installed on their shaft 36 such that their ends remote from the protuberances face each other. The first and second pair of massage rollers 119 and 122 are identical rollers and installed in the same way on their respective shafts 36.

Figure 9:
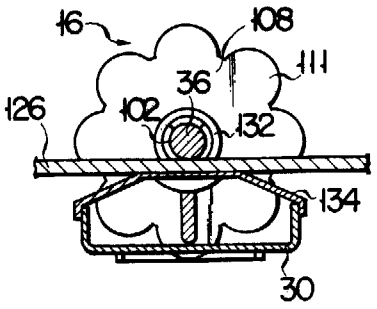
FIG. 9 is a sectional view taken on line IX—IX of FIG. 8.

A control plate 126 in the form of a belt is provided for controlling the operation of the chiropractic rollers of the pressure means 16 within the housing 12 such that the control plate 126 extends substantially over the entire length of the housing. As seen from FIG. 1, the control plate 126 is coupled at one end by a hook-like coupling member 128 to the right-hand end of the housing 12 and coupled at the other end by a tension spring 130 to the left-hand end of the housing. As seen from FIG. 9 the control plate 126 extends between each of the supports 30 and 32 of the support frame 14 and each shaft 36. As shown in FIG. 6, a portion of the control plate 126 extending between the first support 30 and associated shaft 36 is clamped between flanges 132 formed on the respective first pair sleeve 102. As shown in FIG. 9, a leaf spring 134 is provided on the support 30, and it urges the control plate 126 against the sleeves 102 and thus maintains the clamped state of the control plate between the flanges 132. The width of the control plate 126 suitably varies over its length. More particularly, as shown in FIG. 8, the control plate 126 has such a form that its portion corresponding to the neck of the user laying on the sheet 28 with the head directed on the side of the first support 30 is narrowest and that its width is progressively increased from its portion corresponding to the neck of the user to its portion corresponding to the hip of the user. Thus, when the support frame 14 is moved along the housing 12, the first pair of chiropractic rollers 108 carried on the first support 30 are moved in the axial direction of the shaft against the restoring forces of the pair of springs 118 according to the width dimension of the control plate 126. As shown in FIG. 8, the portion of the control plate 126 corresponding to the head of the user becomes progressively wider as it goes from a portion corresponding to the neck toward a portion corresponding to the lower part of the body. This variation of the width of the control plate 126 is provided because of the fact that the thickness of the backbone and hence the distance between the opposite side particular physiological spots vary similarly.

Now, the operation of the chiropractic therapy and massage apparatus 10 of the above construction will be described. First, the operation in the case when the control bar 22 is deformed to the form as shown by the broken lines in FIG. 2 by turning the select lever 84 in the clockwise direction will be described. By operating the timer 88, the power source 21 is started to drive the support frame 14. It is assumed that with the rotation of the drive pulley 44 of the power source 21 the support frame 14 is moved toward the power source 21, i.e., to the left. When the second support 32 of the support frame 14 is moved to a position corresponding to the bent portion 76 of the control bar 22 on the left side, the actuating pin 80 depending from the second support 32 engages with the bent portion 76 and causes sliding of the control bar 22 in the direction of movement of the support frame 14, i.e., to the left. As a result, the hair-pin-like left end 81 of the control bar 22 changes the switch 24, thus reversing the direction of rotation of the reversible motor 20 of the power source 21 to reverse the direction of movement of the support frame 14, i.e., to the right. When the second support 32 having the actuating pin 80 subsequently comes to a position corresponding to the bent portion 77 of the control bar 22 on the right side, the actuating pin 80 engages with the bent portion 77 and causes sliding of the control bar 22 in the direction of movement of the support frame 14, i.e., to the right. As a result, the left end 81 of the control bar 22 is separated from the switch 24 and thus changes the switch 24 again to reverse the direction of rotation of the motor 20 so as to reverse the direction of movement of the support frame 14, i.e., this time to the left.

In this way, during the preset period of the timer 88 the support frame 14 is reciprocated between a position, at which the actuating pin 80 depending from the second support 32 engages with the left side bent portion 76, and a position, at which the actuating pin 80 engages with the right side bent portion 77, i.e., substantially over the entire length of the housing 12. Thus, the whole body of the user lying on the sheet 28 is given chiropractic therapy by the chiropractic rollers 108 and 120 of the pressure means 16 and also with massage by the massage rollers 114 and 122 of the means 16.

When it is desired to reduce the stroke of the support frame 14, i.e., to obtain concentrated chiropractic therapy and massage on a portion of the body, the connecting rod 86 of the stroke selection means 26 is inwardly displaced by turning the select lever 84 in the counter-clockwise direction. As a result, the control bar 22 is restored from its deformed state shown by the broken lines in FIG. 1 to its substantially straight state shown by the solid lines. In this case, the actuating pin 80 depending from the second support 32 of the support frame 14 is able to engage with the central bent portion 78 as well as the other bent portions 76, 77 of the control bar 22. Thus, the support frame 14 is now capable of being reciprocated between a position at which the actuating pin 80 engages with the left side bent portion 76 and a position at which the pin engages with the central bent portion 78 or between a position at which the pin engages with the central bent portion 78 and a position at which the pin engages with the right side bent portion 77, so that the user can obtain chiropractic therapy by the chiropractic rollers 108 and 120 and massage by the massage rollers 114 and 122 on a portion of the body.

When the support frame 14 is reciprocated substantially over the entire length of the housing 12, it is vertically rocked by the cam portions 70 of the rails 17. That is, as seen from FIG. 4, the pressure means 16 supported on the support frame 14 is upwardly displaced to follow the profile of the user's back, so that the chiropractic rollers 108 and 120 and massage rollers 114 and 122 of the pressure means 16 are moved while applying substantially uniform pressure to the back of the user. Thus, the user can receive satisfactory chiropractic therapy and massage over the whole body.

Also, since the stroke of the support frame 14, which supports the pressure means 16 and is reciprocated in the longitudinal direction of the housing 12, can be readily changed by the stroke selection means 26, the user can obtain chiropractic therapy and massage either over the whole body or a portion of the body depending upon the condition of the body, which is very convenient.

Further, with the above construction, as the support frame 14 is moved through the housing 12 the first support 30 is reciprocated over a portion of the user's body from the neck to the hip, so that the first pair of chiropractic rollers 108 provided on the central portion of the shaft 36 apply pressure to the particular physilogical spots on the opposite sides of the backbone with their protuberances 111 as they slide in the axial direction of the shaft 36 according to the changing width dimension of the control plate 126, while at the same time the first pair of massage rollers 114 provided on the outer side of the respective first chiropractic rollers 108 rub the muscle and ligament in a portion of the body extending from the shoulders to the hip with their ridges 116. Simultaneously, the second support 32 is reciprocated over a portion of the user's body extending from the hip to the end of the legs, so that the second pair of rollers 120 provided on the shaft 36 apply pressure to the particular physiological spots of the legs with their protuberances 124 while at the same time the second pair massage rollers 122 rub the muscles of the whole legs with their ridges 116. In other words, in conformity to the well known fact that the distance between the particular physiological spots of the legs is greater than the distance between the particular physiological spots on the opposite sides of the backbone, the lateral distance between the protuberances 124 of the second pair of chiropractic rollers 120 is made greater than the distance between the protuberances 111 of the first pair of chiropractic rollers 108. Thus, the user can obtain chiropractic therapy on the particular physiological spots on the opposite sides of the backbone and those of the legs by the chiropractic rollers 108 and 120 by merely lying on the sheet 28 in the natural posture.

Still further, the distance between the protuberances 124 of the second chiropractic rollers 120 and the ridges 116 of the second massage roller 122 is made narrower, each leg of the user is sandwiched between the protuberances 124 and ridges 116, so that it is possible to obtain very satisfactory chiropractic effect and massage effect on the muscles of the legs.

Further, the pressure means 16 supported on the support frame 14 includes a pair of first chiropractic roller 108 and second chiropractic roller 120 as the pressure rollers. Since the chiropractic rollers 108 and 120 are provided with the respective protuberances 111 and 124 such that the lateral distance between the opposite protuberances 124 is made greater than that between the opposite protuberances 111, the user lying on the sheet 28 in the natural posture can obtain pressure application to the particular physiological spots on the opposite sides of the backbone and those of the legs in the different space by the protuberances 111 and 124 of the first and second chiropractic rollers 108 and 120, that is, the user can receive satisfactory chiropractic therapy without need of an unnatural posture.

Further, the pressure means 16 has not only the chiropractic rollers 108 and 120 but also the pair of first massage rollers 114 and the pair of second massage rollers 122. Thus, the user on the sheet 28 can receive not only the chiropractic effect by the chiropractic rollers but also the massage effect by the massage rollers.

In the above embodiment the pressure rollers of the pressure means 16 are provided on a pair of shafts 36. As shown by broken lines in FIG. 8, it is also possible to provide a separate shaft carrying first chiropractic rollers and massage rollers in the first support 30 and provide a separate shaft carrying second chiropractic rollers and second massage rollers in the second support 32, these rollers being of the same configurations and arrangements as those in the above embodiment. With such a construction, a chiropractic therapy and massage are continuously performed by the number of chiropractic rollers and massage rollers, so that the chiropractic and massage effects can be cumulatively increased.

Figures 1, 10:
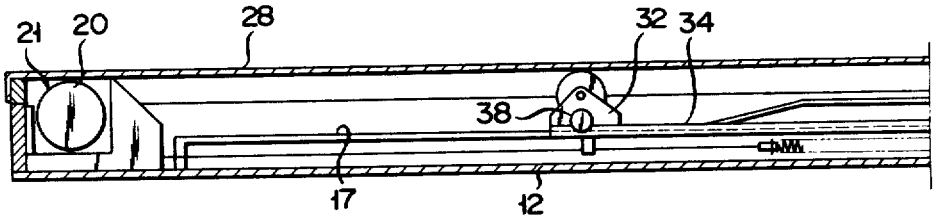
FIGS. 10 and 11 are views respectively similar to FIGS. 1 and 2 but showing a second embodiment of the invention.
Figures 1, 11:
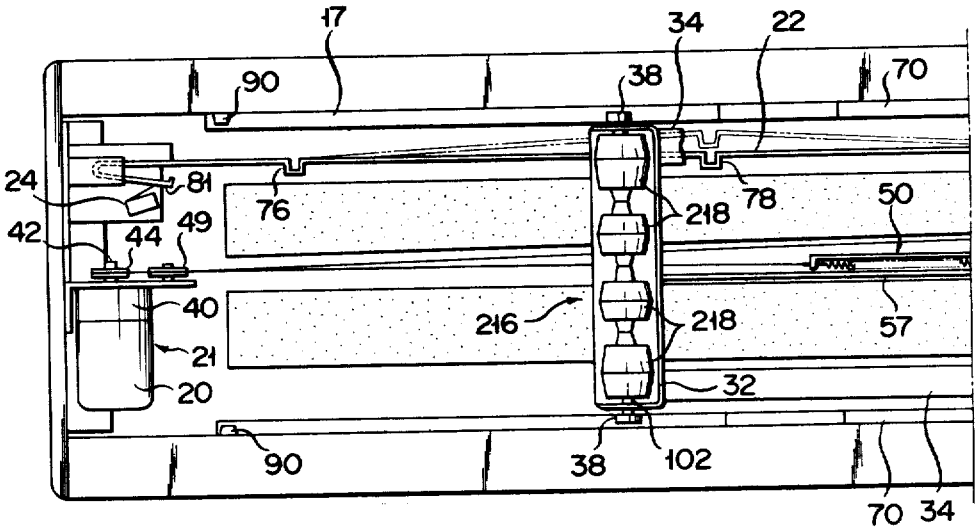
Figures 2, 10:
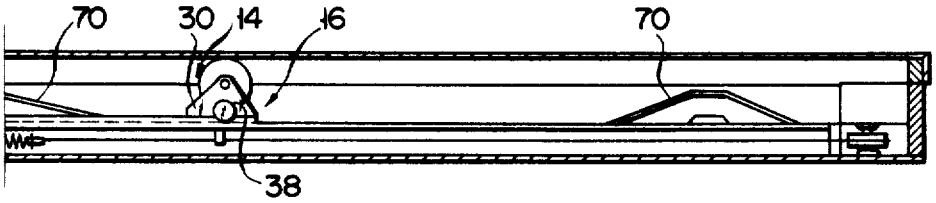
Figures 2, 11:
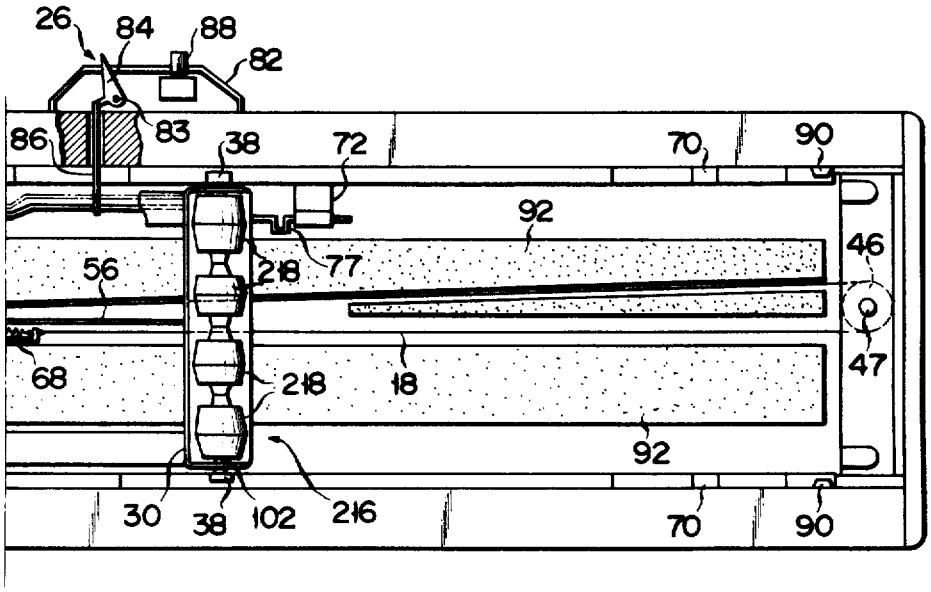

FIGS. 10 and 11 show a second embodiment of the chiropractic therapy and massage apparatus according to the invention.

This chiropractic therapy and massage apparatus 210 is different from the apparatus 10 of the first embodiment in the pressure means. More particularly, in this chiropractic therapy and massage apparatus 210, the construction of pressure means 216 is simplified compared with the means 16 in the apparatus 10. This pressure means 216 has eight pressure rollers 218 with the respective four rollers as a set. These rollers 218 are only provided with ridges and are rotatably mounted on associated shafts supported in respective supports 30 and 32. In this chiropractic therapy and massage apparatus 210, the control plate 126 in the first embodiment is omitted, and the pressure rollers 218 are not moved in the axial direction of the shafts. The other construction of the apparatus 210 is the same as in the first embodiment and is thus not described in detail. Since the chiropractic therapy and massage apparatus 210 is simplified in construction, it can be manufactured at a cheap cost.

As described above, the chiropractic therapy and massage apparatus according to the invention comprises means coupled to both ends of a wire for absorbing the elongation and contraction of the wire and means for coupling the both ends of the wire to a support frame for transmitting the driving force of the wire directly to the support frame without transmitting the driving force to absorbing means. In such a construction, since the driving force of the wire is transmitted directly to the support frame, the support frame can be smoothly driven without generation of noise and the absorbing means will not be damaged by the tension in the wire. Further if the wire undergoes elongation or contraction, this elongation or contraction is absorbed by the absorbing means. Thus fluctuation of the wire tension can be prevented and the wire is driven under a constant tension.

What we claim is:

1. An apparatus for chiropractic therapy and massage comprising a housing on which an user may lie, pressure means including a number of pressure rollers disposed in the housing and adapted to roll to apply pressure on the body of the user lying on the housing, a support frame provided in the housing and supporting the pressure means, a pair of pulleys provided in the housing, and a wire stretched between the pulleys to reciprocate the support frame, characterized in that the apparatus further comprises:

means coupled to both ends of said wire for absorbing the elongation and contraction of said wire; and means coupling both ends of said wire to said support frame for transmitting the driving force of said wire directly to said support frame without transmitting the driving force to said absorbing means.

2. An apparatus according to claim 1, in which said wire coupling means includes first and second interlock members, said first interlock member having two ends and being coupled at one end thereof to one end of said wire so as to be first slidable relative to the wire and then movable together with the wire when said wire is driven in one direction, and being coupled at the other end thereof to said support frame so as to drive said support frame in the same direction as said wire is driven; and said second interlock member having two ends and being coupled at one end thereof to the other end of said wire so as to be second slidable relative to the wire and then movable together with the wire when said wire is driven in the other direction, and being coupled at the other end thereof to said support frame so as to drive said support frame in the same direction as said wire is driven.

3. An apparatus according to claim 2, in which said absorbing means comprises a tension spring stretched between the ends of said wire.

4. An apparatus according to claim 2, further comprising:

stroke control means slidably provided in said housing, and having a number of engagement portions each being engageable with said support frame and being moved together with said support frame when one of said engagement portions engages with said support frame;

stroke selection means coupled to said stroke control means for selecting another of said engagement portions, thereby to adjust the stroke of said support frame and said stroke control means; and a power source including a reversible motor for driving said wire and a switch for rotating the motor in reverse direction when actuated by said stroke control means.

5. An apparatus according to claim 4, in which said stroke control means includes a control bar having engagement portions and being elastically deformable in the sidewise direction, one of said engagement portions being replaced by another when said control bar is deformed; and said stroke selection means includes an actuating rod slidably disposed in said housing and coupled at one end to said control bar, and a select lever pivotally disposed in said housing and coupled at one end to the other end of said actuating rod, said control bar being deformed when said select lever is moved pivotally.

6. An apparatus according to any one of claims 1 to 5, further comprising:

a sheet stretched to cover an open side of said housing; and elastic protective means provided between said wire and said sheet and having a top side positioned above said wire stretched horizontally.

7. An apparatus according to claim 6, in which said elastic protective means is made of a semi-hard foam material.

8. An apparatus according to claim 7, in which said semi-hard foam material is polyethylene foam.

9. An apparatus according to any one of claims 1 to 4, further comprising:

a control plate provided in said housing, extending in the direction in which said support frame is moved, and having a portion whose width varies in conformity with the thickness of the user's backbone; and also in which said pressure means includes a first pair of chiropractic rollers rotatably and slidably mounted on a first shaft supported on said support frame and extending substantially perpendicular to the direction in which said support frame is moved, said chiropractic rollers being provided respectively on one side and the other of said control plate, each said roller having a number of protuberances on the outer periphery thereof for applying pressure to particular physiological spots of the user, and being urged by urging means so as to be moved in the axial direction of said first shaft toward and away from each other according to the width of said control plate as said pressure means is moved together with said support frame.

10. An apparatus according to claim 9, in which said first pair of chiropractic rollers are supported in a first pair of sleeves mounted on said first shaft such that the chiropractic rollers rotate together and move independently of each other in the axial direction of said first shaft.

11. An apparatus according to claim 9, in which said pressure means further includes a first pair of massage rollers rotatably mounted respectively on the end portions of said first shaft and each having a number of ridges on the outer periphery thereof.

12. An apparatus according to claim 11, in which said pressure means further includes a second pair of chiropractic rollers rotatably mounted on a second shaft supported on said support frame, extending substantially perpendicular to the direction in which said support frame is moved, and each having a number of protuberances on the outer periphery thereof for applying pressure to particular physiological spots of the user, said second pair of chiropractic rollers being positioned respectively on one side and the other of that portion of said control plate whose width remains constant.

13. An apparatus according to claim 12, in which said pressure means further includes a second pair of massage rollers rotatably mounted respectively on the end portions of said second shaft and each having a number of ridges on the outer periphery thereof.

14. An apparatus according to claim 13, in which said first pair of massage rollers are identical with said second pair of massage rollers, and said first pair of chiropractic rollers are identical with said second pair of chiropractic rollers except that said protuberances are formed on those peripheral portions of said first chiropractic rollers which are close to each other, whereas said protuberances are formed on those peripheral portions of said second chiropractic rollers which are remote from each other.

* * * * *